US010487487B2

(12) United States Patent
Slye

(10) Patent No.: US 10,487,487 B2
(45) Date of Patent: Nov. 26, 2019

(54) MOBILE CLEANING DEVICE AND METHOD OF USE

(76) Inventor: Mark Slye, Cincinnati, OH (US)

( * ) Notice: Subject to any disclaimer, the term of this patent is extended or adjusted under 35 U.S.C. 154(b) by 0 days.

(21) Appl. No.: 13/537,557

(22) Filed: Jun. 29, 2012

(65) Prior Publication Data

US 2013/0000744 A1 Jan. 3, 2013

Related U.S. Application Data

(60) Provisional application No. 61/502,930, filed on Jun. 30, 2011.

(51) Int. Cl.

| | |
|---|---|
| ***E03D 9/00*** | (2006.01) |
| ***E03D 5/00*** | (2006.01) |
| ***E03D 1/00*** | (2006.01) |
| ***B65D 1/00*** | (2006.01) |

(52) U.S. Cl.

CPC ..... *E03D 9/00* (2013.01); *B65D 1/00* (2013.01); *E03D 1/00* (2013.01); *E03D 5/00* (2013.01); *E03D 5/003* (2013.01); *E03D 5/006* (2013.01); *Y10T 137/0424* (2015.04); *Y10T 137/86236* (2015.04)

(58) Field of Classification Search

CPC ..... E03D 9/00; E03C 1/304
USPC ..... 4/661, 255.01–255.06, 490, 404, 409, 4/411, 435

See application file for complete search history.

(56) References Cited

U.S. PATENT DOCUMENTS

| | | | | | |
|---|---|---|---|---|---|
| 369,843 | A * | 9/1887 | Douglas | E03D 1/34 | 4/411 |
| 1,918,048 | A * | 7/1933 | Marxman | 134/168 R | |
| 2,266,288 | A * | 12/1941 | Thompson | 134/167 R | |
| 2,315,824 | A * | 4/1943 | Sweeny | 4/433 | |
| 3,327,323 | A * | 6/1967 | Miller, Jr. | E03F 7/10 | 137/240 |
| 4,402,093 | A * | 9/1983 | Luker et al. | 4/427 | |
| 5,109,880 | A * | 5/1992 | Booth | 134/108 | |
| 5,363,513 | A * | 11/1994 | Blankenburg | E03D 3/10 | 4/354 |
| 5,862,536 | A * | 1/1999 | Huang | 4/353 | |
| 6,032,301 | A * | 3/2000 | Wang | 4/255.06 | |
| 6,205,594 | B1 * | 3/2001 | Solaberry | E03C 1/308 | 4/255.01 |
| 6,206,980 | B1 * | 3/2001 | Robinson | 134/21 | |
| 6,516,836 | B2 * | 2/2003 | Fields | B60R 15/00 | 141/301 |
| 2005/0005350 | A1 * | 1/2005 | Johnson | A61G 7/0005 | 4/585 |

* cited by examiner

*Primary Examiner* — Christine J Skubinna
(74) *Attorney, Agent, or Firm* — The Dobrusin Law Firm, PC

(57) ABSTRACT

A mobile cleansing device is described, having particular use for providing toilet and spill maintenance during water shortages and water stoppages. The device may include a tank, a releasing mechanism, a channel, and a valve.

20 Claims, 6 Drawing Sheets

MOBILE CLEANING DEVICE AND METHOD OF USE

CLAIM OF PRIORITY

This application claims the benefit of the filing date of U.S. Provisional Application Ser. No. 61/502,930 filed on Jun. 30, 2011, the entirety of the contents of that application being hereby expressly incorporated by reference.

FIELD OF THE INVENTION

The present teachings relate to a mobile system for toilet and spill maintenance. More specifically, the present teachings relate to a mobile system that includes its own water source for cleaning purposes during water shortage or stoppage.

BACKGROUND OF THE INVENTION

With a growing need for adequate emergency preparation in large facilities such as hospitals and nursing homes, the risk of water shortage and water stoppage presents unique challenges. Large facilities where medical care is provided rely on water and many water-based substances for numerous aspects of care. During planned water stoppages or those that occur in an emergency, these facilities must still provide adequate care and thus require a functioning water source. The nursing staff must consistently clean and sanitize bedpans, so toilets need to be flushed frequently even during a water stoppage. Traditionally, when water is unavailable, facilities maintenance staff must travel to every restroom in the facility with buckets of water in order to provide the liquid necessary to flush each toilet. This practice is highly time consuming and requires a large maintenance staff in order to sufficiently meet patient care needs. The process is also unsanitary and often requires additional clean up steps once the toilet has been manually flushed.

Notwithstanding the above, there remains a need for a device that can provide a mobile water source for large facilities in the event of a water shortage or stoppage. It would be further beneficial if the device were easy to move from one room to another and would provide a sanitary means for handling waste and other spills.

SUMMARY OF THE INVENTION

The present teachings address one or more of the above needs by providing a mobile cleansing device. The cleansing device may include a tank portion, a first opening located in a wall of the tank portion, a valve located within the first opening and a removable valve disc that creates a seal when placed on a valve seat that together are the valve body. The device may further include a releasing mechanism located adjacent the tank portion wherein a portion of the releasing mechanism contacts the removable valve disc. The device may also include a channel located adjacent the first opening, wherein the valve body is located into the first opening to prevent the flow of any tank contents from the tank to the channel and the removable valve disc is disengaged from the valve seat to allow for flow of tank contents into the channel. The channel may include a rigid portion and/or a flexible portion. At least a portion of the tank may be frusto-conical in shape. The tank may include a second opening that substantially opposes the first opening. The second opening may include a lid having an aperture. The aperture may also be located anywhere on the tank at or above the removable valve disc portion of the valve body, through which at least a portion of the releasing mechanism extends into the tank. The first opening may have a diameter of at least about 2 inches. The first opening may have a diameter of less than about 6 inches. The channel may include a terminal end for contacting a toilet bowl. The channel may include a terminal end having a protective halo for controlling splash during use of the device. The tank may include an outlet opening for attaching to an outlet hose. The outlet hose may include a power source. The valve body may be shaped to engage in a friction fit with the first opening. The releasing mechanism may include an arm portion located substantially along the exterior of the tank. The releasing mechanism may include a connector portion for connecting the arm portion to the removable valve disc. The tank may be located onto a stand so that the height of the tank is at least about 20 inches. The portion of the channel located closest to the opening may be rigid, while the portion of the channel located remote from the opening may be flexible.

In another aspect, the present teachings contemplate a method for flushing a toilet during a water shortage comprising the steps of providing a tank having a first opening and a second opening substantially opposing the first opening and locating a valve body within the tank so that it seals the first opening. The method may also include providing a cover over the second opening. The method may include providing an aperture located anywhere on the tank at or above the removable valve disc portion of the valve body, wherein the cover includes an aperture. At least a portion of a releasing mechanism may be located through the aperture so that a connector portion of the releasing mechanism contacts the removable valve disc within the tank and an arm portion of the releasing mechanism remains adjacent the exterior of the tank. The method may include providing a channel adjacent the first opening, and locating a liquid within the tank, whereby the valve body prevents the liquid from traveling from the tank into the channel. A force may be exerted on the arm portion of the releasing mechanism so that the connector portion of the releasing mechanism disengages the removable valve disc from the valve seat to allow the liquid to exit the tank by flowing out of the first opening and into the channel. Upon disengaging the removable valve disc from the valve, the liquid may be forced out of the first opening and through the channel into a toilet bowl so that the liquid flushes the toilet. Upon disengaging the removable valve disc from the valve seat, the liquid may initially exit the valve seat and first opening and then enter a rigid portion of the channel and may subsequently enter a flexible portion of the channel.

The device of the present teachings provides a mobile water-based substance source which can be utilized by larger facilities for sanitary and spill maintenance. The device further allows for a mobile toilet flush capability during water shortage or stoppage.

DETAILED DESCRIPTION

The device disclosed herein includes a tank having a first opening and a valve body that is removably located within the first opening. The valve body may be comprised of a valve body and a valve seat. The removable valve disc may be attached to a releasing mechanism that controls the movement of the removable valve disc into and out of the valve seat. At least a portion of the releasing mechanism may extend out of the tank through a second opening located substantially opposing the first opening. The first opening may be located adjacent a channel so that upon disengagement of the removable valve disc from the valve seat, at least a portion of the contents of the tank may travel through the valve seat and first opening and into the channel portion.

Figure 1:
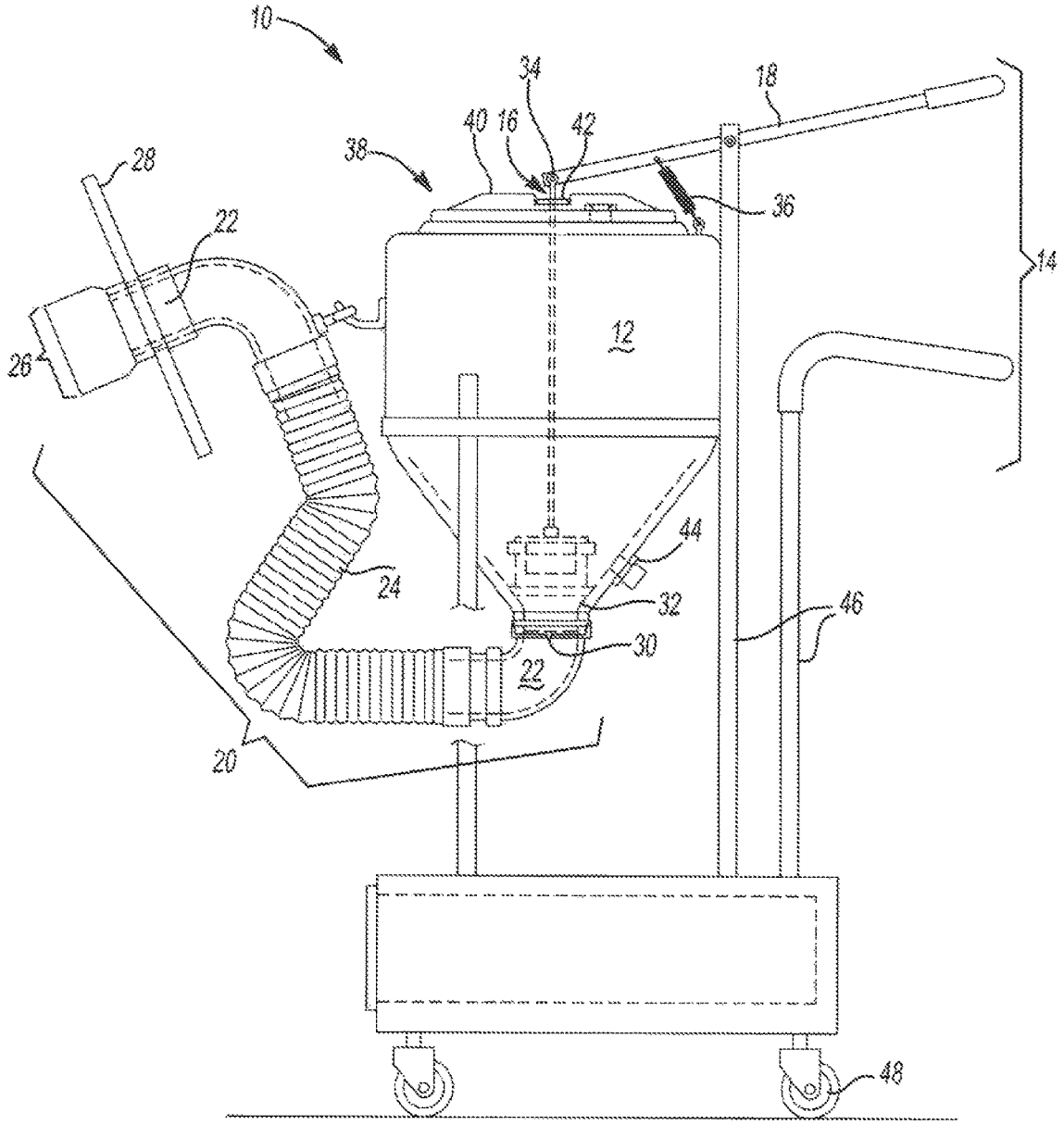
FIG. 1 is a perspective view of an illustrative example of a device in accordance with the present teachings.

As shown for example in FIG. 1, the illustrated device 10 includes a tank 12, a releasing mechanism 14 including a connector portion 16 and an arm portion 18, and a channel 20. The channel 20 may include a rigid portion 22 and/or a flexible portion 24. The channel may include a terminal end 26 located adjacent the flexible portion 24. The terminal end 26 may include a protective halo 28 and may also be substantially rigid. A first opening 30 may be located in a wall 32 of the tank 12. At least a portion of the connector portion 16 may be located within the tank 12, while a portion of the connector portion 16 may be located outside the tank 12. The arm portion 18 may be attached to the connector portion 16 via a fastening mechanism 34 while the arm portion 18 is located substantially external to the tank 12. A spring 36 may be attached to the arm portion 18 and the tank 12 to assist in movement of the releasing mechanism 14. The tank 12 may include a second opening 38 through which the connector portion 16 of the releasing mechanism 14 enters the tank 12. The second opening 38 may include a cover 40 having an aperture 42 located thereon. The aperture 42 may also be located anywhere on the tank 12 at point where the releasing mechanism 14 is still functional. The connector portion 16 of the releasing mechanism 14 may enter the tank 12 through the aperture 42. The tank may include a third opening 44 which may be capable of connection to an additional hose. The device may be located onto a stand 46 so that the first opening 30 lies above any item (e.g., a toilet) that requires flushing or cleaning. The stand 46 may be located onto one or more wheels 48 to allow for simplified movement of the device between locations. In further embodiments of the invention the arm portion 18 may be any other means of opening a valve such as a handle, a button, a peddle or any other means known in the art.

Figure 2A:
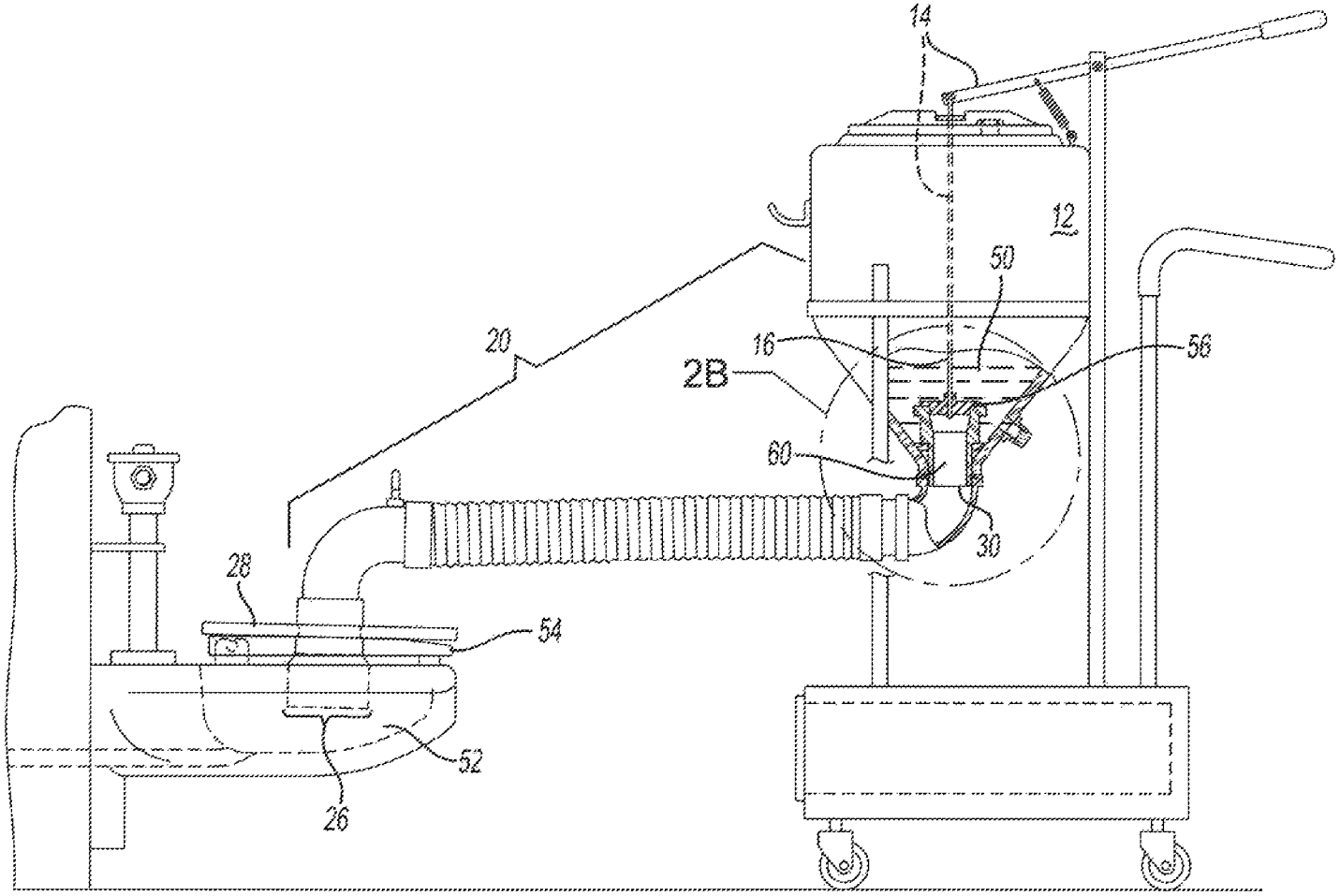
FIG. 2A is a profile view of the device of FIG. 1 shown prior to releasing liquid from the tank to the channel.

FIG. 2A depicts a device in accordance with the present teachings in use for purposes of toilet cleansing. The device is shown containing a liquid 50 within the tank 12, prior to the release of any liquid 50 through the first opening 30 and into the channel 20. The liquid may be provided to the tank from any water source, which may include grey water tanks present at large care facilities. The terminal end 26 of the channel 20 is placed into a toilet bowl 52 so that the protective halo 28 rests on the seat portion 54 of the toilet.

Figure 2B:
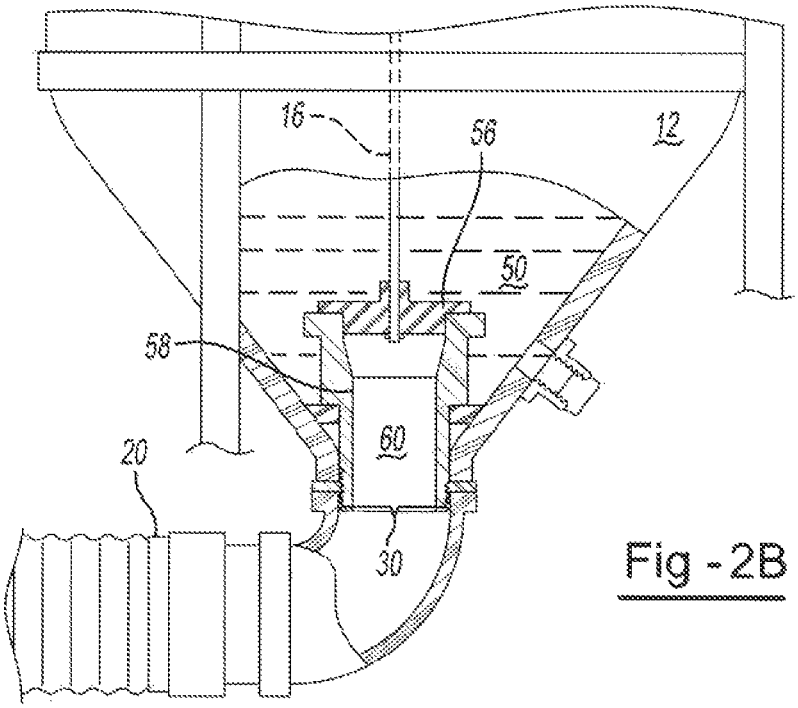
FIG. 2B is a cross-sectional view of the tank of FIG. 2A.

FIG. 2B depicts the connector portion 16 of the releasing mechanism 14 is fastened to the removable valve disc 56. The figure further illustrates a valve body 58 that is shaped to form a friction fit with the first opening 30. A removable valve disc 56 and a valve seat 60 makes up the valve body 58. The removable valve disc 56 may be attached to the connector portion 16 of the releasing mechanism 14. The valve seat 60 may be located within the first opening 30. As shown at 2B.

In another embodiment the seat portion 54 is first lifted up and terminal end 26 of the channel 20 is then placed into the toilet bowl 52, so that the protective halo 28 rests directly on the toilet rim 62 preventing any spills that would otherwise occur between the seat portion 54 and the toilet rim 62.

Figure 3B:
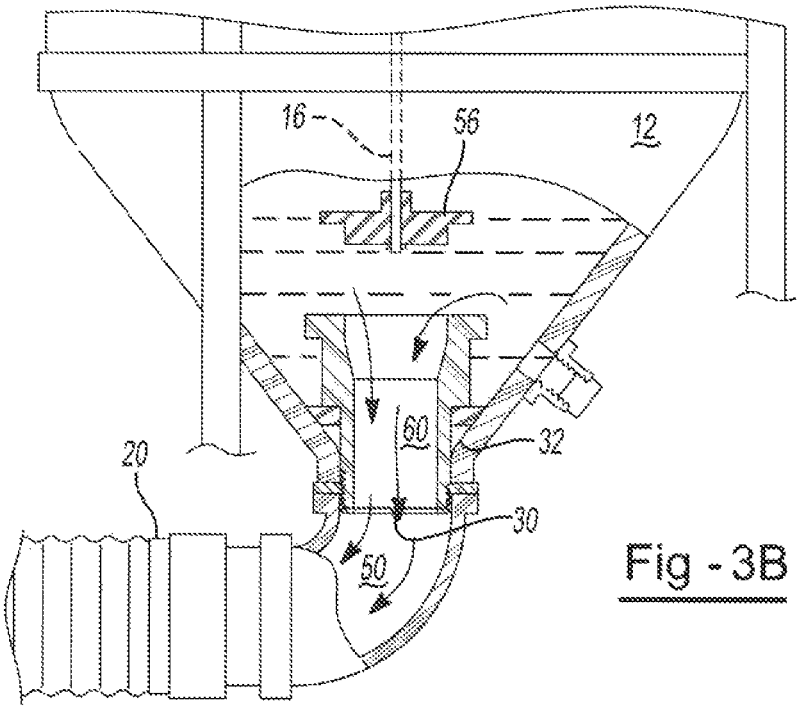
FIG. 3B a cross-sectional view of the tank of FIG. 3A.
Figure 3A:
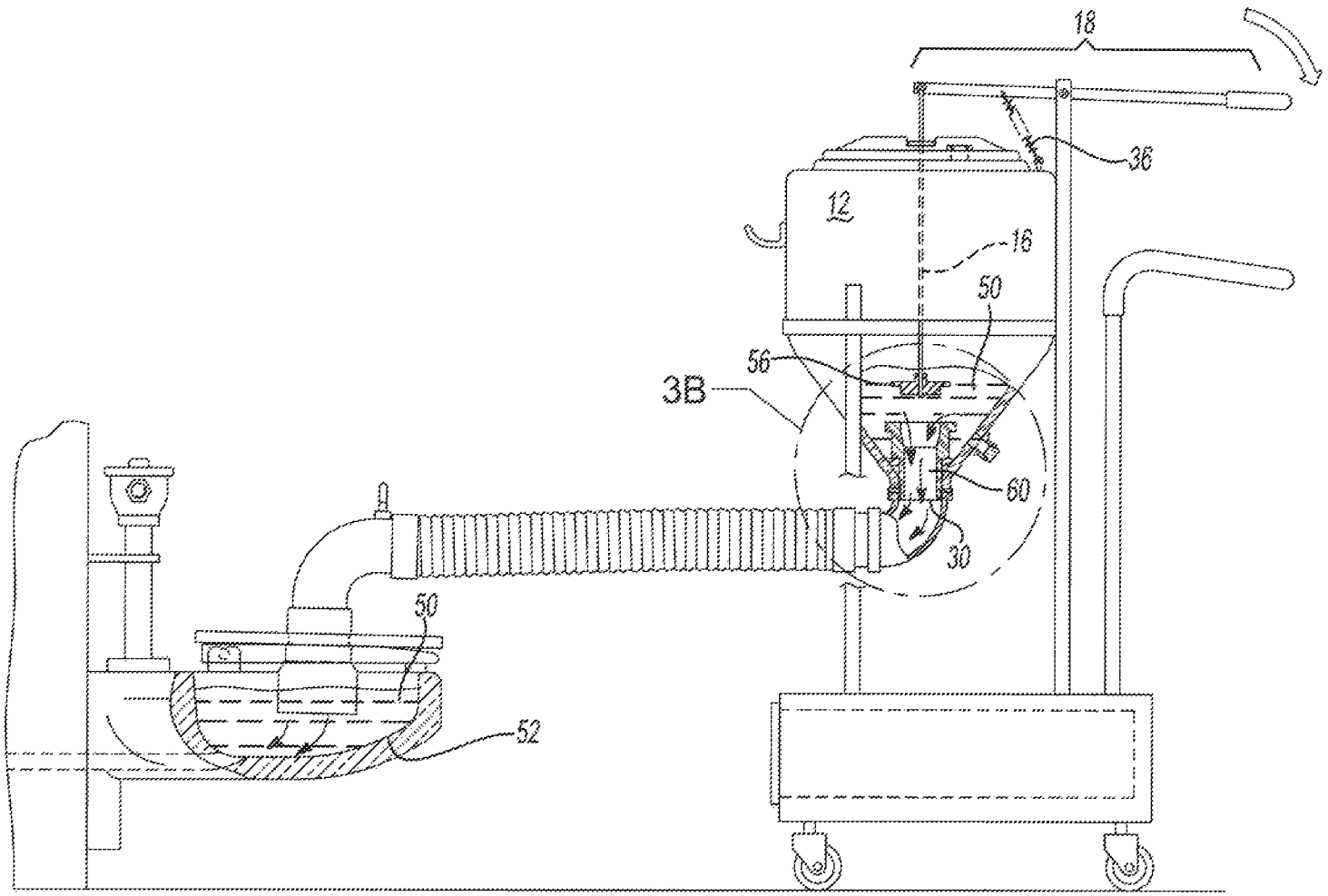
FIG. 3A is a profile view of the device of FIG. 1 shown after releasing liquid from the tank to the channel.

FIGS. 3A and 3B show the device of FIGS. 2A and 2B upon release of the liquid 50 through the first opening 30 and into the channel 20. To allow the liquid 50 to move through the first opening 30, the removable valve disc 56 must be disengaged from the first opening 30. To do so, a user may exert downward pressure onto the arm portion 18 of the releasing mechanism 14. This may cause the connector portion 16 to be pulled in the respective direction of the releasing mechanism which in turns pulls upward on the removable valve disc 56 to dislodge the removable valve disc 56 from engagement with the valve seat 60. This allows the liquid 50 of the tank 12 to flow into the valve seat 60. The liquid 50 may then travel through the first opening 30, into the channel 20 and into the toilet bowl 52 so that the force of the liquid causes any contents of the toilet bowl to be flushed. The spring 36 may exert a force upon the arm portion 18 of the releasing mechanism 14 so that the connector portion 16 of the releasing mechanism 14 may be able to return to its original position within the tank after the necessary liquid exits the tank.

In another embodiment of this invention the removable valve disc 56 may be hinged to the valve seat 60. Whereupon disengagement of the removable valve disc 56, the liquid 50 of the tank 12 may flow to into the valve seat 60, and then travel through the first opening 30, into the channel 20 and into the toilet bowl 52 so that the force of the liquid causes any contents of the toilet bowl to be flushed. In this embodiment the removable valve disc 56 remains only partially engaged to the valve seat 60 for the deration of time that one exerts pressure on the arm portion 18 of the releasing mechanism 14. In other embodiments of the invention, the amount of pressure required to be exerted on the arm portion 18, of the releasing mechanism 14 and the direction in which it is exerted is determined by the valve opening means used.

Figure 4:
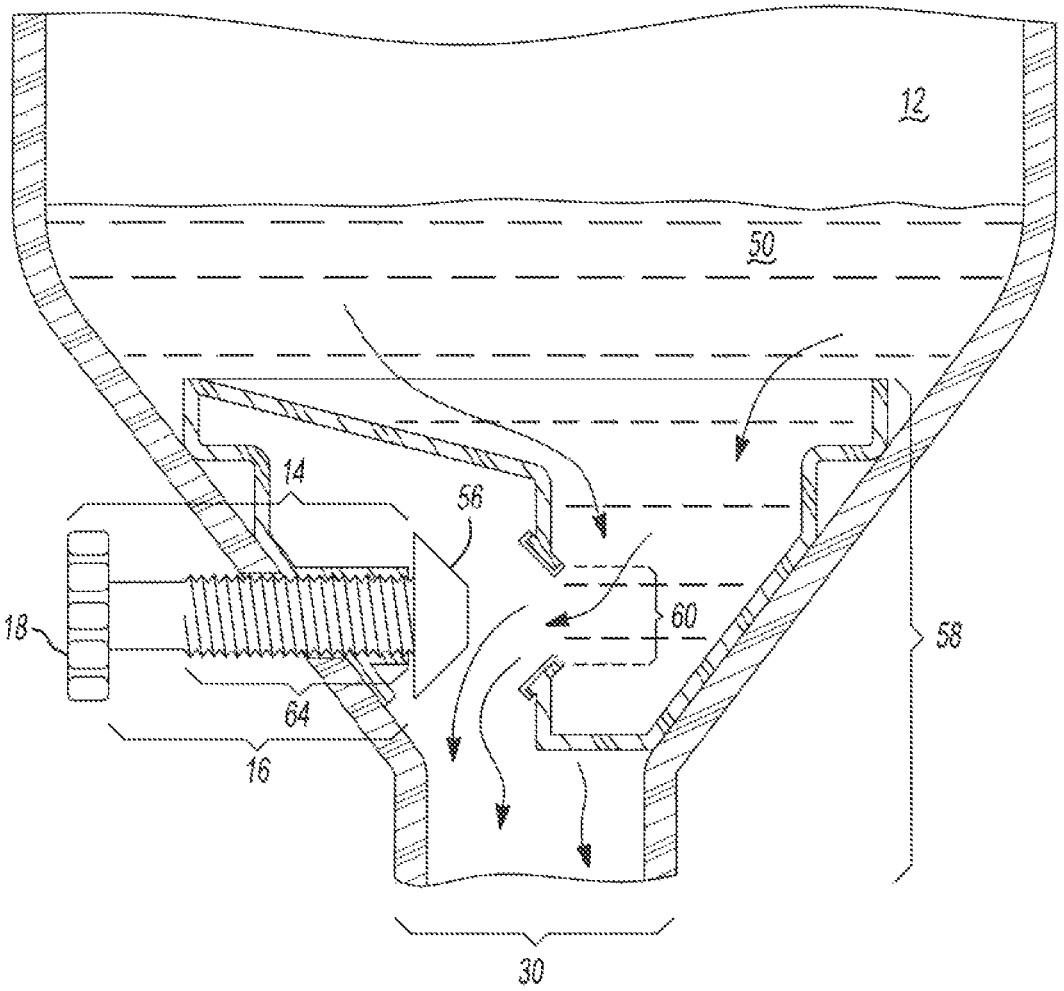
FIG. 4 is an illustration of another embodiment of the releasing mechanism.

FIG. 4 shows another embodiment of the releasing mechanism. In this embodiment the function of the releasing mechanism may further be modified by moving the arm portion to the wall 32 of the tank 12 above the first opening 30 and having the connector portion pass through the valve body 58 and attach to the removable valve disc 56. FIG. 4 further illustrates that in some embodiments the arm portion 18 may not require the application of constant pressure while the liquid 50 is released from the tank 12, for example the connector portion 16 may be a helical thread 64 which requires one to turn the arm portion 18 to disengage the removable valve disc 56 from the valve seat 60. valve the constant may not be required while in others The function of the releasing mechanism may further be modified by use of a solenoid valve (not shown) with a power source. The solenoid valve may eliminate the need for the releasing mechanism as disclosed above such that the removable valve disc can be automatically actuated without need for manual force, such as that required to utilized the releasing mechanism.

Figure 5:
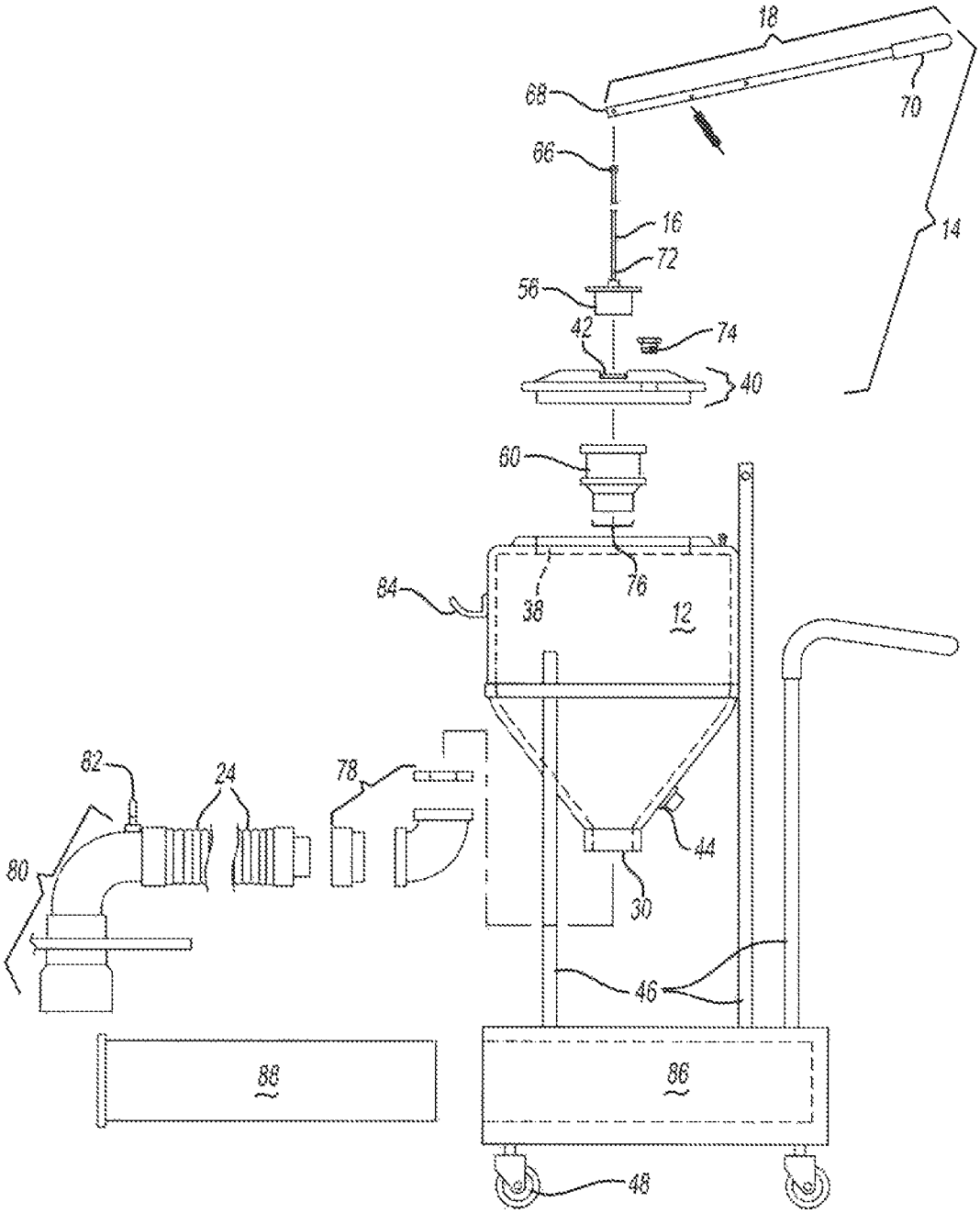
FIG. 5 is an exploded view of the device of FIG. 1.

FIG. 5 shows an exploded view including illustrative examples of elements that may be present in the device in accordance with the present teachings. The tank 12 may include one or more openings including but not limited to a first opening 30, a second opening 38, and a third opening 44. The third opening 44 may be adapted for attachment to a hose (not shown) so that any liquid (not shown) in the tank 12 may be accessed via the hose. A releasing mechanism 14 may be located into and/or adjacent to the tank 12. The releasing mechanism may include a connector portion 16 for connecting the releasing mechanism to a removable valve disc 56, and an arm portion 18. A first end 66 of the connector portion 16 may be attached to a first end 68 of the arm portion. A user may contact a second end 70 of the arm portion 18 to exert a downward force on the arm portion 18 so that the contents of the tank may be released through the first opening 30. A second end 72 of the connector portion 16 may have an attachment means (not shown) for connecting the connector portion 16 to the removable valve disc 56.

The second opening 38 of the tank may be at least partially contacted by a cover 40. The cover 40 may include an aperture 42 through which the connector portion 16 of the releasing mechanism 14 may be located within the tank 12. The cover 40 may also include one or more additional openings (not visible) which may include one or more caps 74 for covering any additional openings.

The valve seat 60 may be placed in the bottom of the tank 12 so that the first opening 30 and the bottom of the valve seat 76 form a continuous opening for any liquid (not shown) to exit the tank 12 into the channel 20 when the removable valve disc 56 is disengaged from the valve seat. The first opening 30 of the tank may be connected to a channel 20. The channel may include a first rigid portion 78 which may be in direct contact with the first opening 30 of the tank. The channel may include at least one flexible portion 24 which may be located in between the first rigid portion 78 and a second rigid portion 80. The second rigid portion 80 may include a protective halo 28 for minimizing unwanted splashing during use. The second rigid portion may also include an attachment means such as a loop 82 so that the channel 20 may be attached to the tank 12 when not in use or while moving the device from one location to a second location. As such, the tank may include an external attachment means such as a hook 84 for receiving the loop 82 of the channel 20.

The device may be located onto a stand 46 so that the tank 12 is positioned at a height wherein the first opening 30 of the tank lies above the height of any item being cleansed. The stand 46 may include a platform 86 which may be adapted with a means for moving the device from one location to another, such as one or more wheels 48. The platform may include a drawer 88 or any storage structure for holding additional cleaning materials or additional components of the device. As an example, the drawer may be adapted to hold a power source for powering the device or a portion of the device if desired. The power source may provide a means for forcing tank contents into and from a hose that may be attached to one or more of the tank openings.

In another embodiment of the invention the channel may be lowered and raised electronically, removing the need for someone to contact the second rigid end. The invention may further be modified so that the tank may be placed directly over the toilet, the terminal end with or without the protective halo may be placed into the toilet allowing flushing of toilets in narrow areas. The channel may be modified so that it can expand for use and then be contracted again for storage. The stand may be modified to be height adjustable so allow it to be raised in lowered over toilets. The stand and/or platform may be modified to include one or more feet. The stand and/or platform may further be modified to add a motor and becoming motorized.

The terminal end may be modified to include a sensor. The sensor in the terminal end may be connected to a light and/or a buzzer that can alert the user that the toilet is not flushing and is likely to overflow. The sensor could also lead to the stoppage of the flow of water. In one embodiment the terminal end is equipped with a closing means which stops the flow of water at the terminal end. The sensor could cause the water flow to stop by either closing the valve or by activating the closing means.

The device may include a spray device that is capable of receiving and expelling water from within the tank. The spray device may include a pump for moving water from the tank through and out of the spray device. The spray device may be used for cleaning and/or rinsing any portion of a toilet during the flush process. The spray device may be used for spraying any surface that may require cleaning and/or rinsing. Any portion of the device, including the spray device, the valve, the arm, the connector, the releasing mechanism or any other portion for facilitating the flushing action of the device may be battery powered. The battery may be attached to and/or stored within the device One or more components of the device, including the tank, the channel, the releasing mechanism, the valve, the protective halo and any covers or caps may be formed of rigid materials that may include polymeric materials including but not limited to thermoplastics, thermoset plastics, elastomeric containing materials or any combination thereof. Examples of polymeric and elastomeric materials that may be employed include nylon, polyvinyl chloride, polypropylene, high-density polyethylene, low-density polyethylene, linear low-density polyethylene, polyvinylidene chloride polyamide, polyester, polystyrene, polyethylene, polyethylene terephthlate, bio-based plastics/biopolymers (e.g., poly lactic acid), silicone, acrylonitrile butadiene styrene (ABS), rubber, polyisoprene, butyl rubber, polybutadiene, EPM rubber, EPDM rubber, or any combination thereof. Additional suitable materials may include bio-plastics such as those derived from wood pulp-based lignin (e.g., liquid wood), sugarcane or other petroleum-free moldable materials. One or more of these components may be formed of a metallic material.

Any numerical values recited herein include all values from the lower value to the upper value in increments of one unit provided that there is a separation of at least 2 units between any lower value and any higher value. As an example, if it is stated that the amount of a component or a value of a process variable such as, for example, temperature, pressure, time and the like is, for example, from 1 to 90, preferably from 20 to 80, more preferably from 30 to 70, it is intended that values such as 15 to 85, 22 to 68, 43 to 51, 30 to 32 etc. are expressly enumerated in this specification. For values which are less than one, one unit is considered to be 0.0001, 0.001, 0.01 or 0.1 as appropriate. These are only examples of what is specifically intended and all possible combinations of numerical values between the lowest value and the highest value enumerated are to be considered to be expressly stated in this application in a similar manner. As can be seen, the teaching of amounts expressed as "parts by weight" herein also contemplates the same ranges expressed in terms of percent by weight. Thus, an expression in the Detailed Description of the Invention of a range in terms of at "x parts by weight of the resulting polymeric blend composition" also contemplates a teaching of ranges of same recited amount of x in percent by weight of the resulting polymeric blend composition."

Unless otherwise stated, all ranges include both endpoints and all numbers between the endpoints. The use of "about" or "approximately" in connection with a range applies to both ends of the range. Thus, "about 20 to 30" is intended to cover "about 20 to about 30", inclusive of at least the specified endpoints.

The disclosures of all articles and references, including patent applications and publications, are incorporated by reference for all purposes. The term "consisting essentially of" to describe a combination shall include the elements, ingredients, components or steps identified, and such other elements ingredients, components or steps that do not materially affect the basic and novel characteristics of the combination. The use of the terms "comprising" or "including" to describe combinations of elements, ingredients, components or steps herein also contemplates embodiments that consist essentially of the elements, ingredients, components or steps. By use of the term "may" herein, it is intended that any described attributes that "may" be included are optional.

Plural elements, ingredients, components or steps can be provided by a single integrated element, ingredient, component or step. Alternatively, a single integrated element, ingredient, component or step might be divided into separate plural elements, ingredients, components or steps. The disclosure of "a" or "one" to describe an element, ingredient, component or step is not intended to foreclose additional elements, ingredients, components or steps.

It is understood that the above description is intended to be illustrative and not restrictive. Many embodiments as well as many applications besides the examples provided will be apparent to those of skill in the art upon reading the above description. The scope of the invention should, therefore, be determined not with reference to the above description, but should instead be determined with reference to the appended claims, along with the full scope of equivalents to which such claims are entitled. The disclosures of all articles and references, including patent applications and publications, are incorporated by reference for all purposes. The omission in the following claims of any aspect of subject matter that is disclosed herein is not a disclaimer of such subject matter, nor should it be regarded that the inventors did not consider such subject matter to be part of the disclosed inventive subject matter.

The invention claimed is:

1. A toilet flushing device comprising:

a mobile frustoconical tank portion for holding a liquid, the liquid for use in flushing a toilet;

a first opening located in a wall of the tank portion, the first opening having a diameter of at least about 2 inches;

a stand upon which the tank sits so that the height of the first opening of the tank is at least about 20 inches from the ground;

a valve body engaged in a friction fit with the first opening and located within the first opening, the first opening having a diameter sufficient to receive the entirety of the valve body while maintaining the valve body within the opening such that the valve body controls flow of water out of the tank;

a removable valve disc, that creates a seal when placed on a valve seat that together are the valve body;

a releasing mechanism located adjacent the tank portion, a portion of the releasing mechanism contacting the removable valve disc, the releasing mechanism including an arm portion located entirely along the exterior of the tank and including a connector portion for connecting the arm portion to the removable valve disc;

a second opening that includes a cover having an aperture through which at least a portion of the releasing mechanism extends into the tank, the second opening substantially opposing the first opening;

a repositionable channel with a first permanently curved non-flexible portion located adjacent the first opening and a second permanently curved non-flexible portion located before a terminal end of the channel for contacting a toilet bowl, the terminal end of the channel includes a protective halo for controlling splash during use of the device;

wherein the channel can be located into and out of the toilet bowl; and wherein the valve body is located into the first opening to prevent the flow of any tank contents from the tank to the channel and the removable valve disc is disengaged from the valve seat to allow for flow of tank contents into the channel; and wherein any tank contents flow from the first opening into the channel and into the toilet bowl to flush any contents of the toilet bowl.

2. The device of claim 1, wherein the channel includes a rigid portion.

3. The device of claim 1, wherein the channel includes a flexible portion.

4. The device of claim 1, wherein the first opening has a diameter of less than about 6 inches.

5. The device of claim 1, wherein the portion of the channel located closest to the opening is rigid, while the portion of the channel located remote from the opening is flexible.

6. A method for flushing a toilet during a water shortage comprising the steps of:

providing a mobile frustoconical tank having a first opening and a second opening substantially opposing the first opening, the first opening located in a wall of the tank and having a diameter of at least about 2 inches and the tank located onto a stand so that the height of the first opening is at least about 20 inches from the ground;

locating a valve within the tank so that it engages in a friction fit with and seals the first opening the first opening having a diameter sufficient to receive the entirety of the valve body while maintaining the valve body within the opening such that the valve body controls flow of water out of the tank, the valve including a valve disc and a valve seat that create a seal when engaged;

providing a cover over the second opening;

providing an aperture located anywhere on the tank or cover at or above the valve;

locating at least a portion of a releasing mechanism through the aperture so that a connector portion of the releasing mechanism contacts the valve within the tank and an arm portion of the releasing mechanism remains adjacent the exterior of the tank, the releasing mechanism further extending through an aperture located in the second opening;

providing a repositionable channel with a first permanently curved non-flexible portion adjacent the first opening and a second permanently curved non-flexible portion located before a terminal end of the channel, the terminal end of the channel including a protective halo for controlling splash during use;

locating a liquid within the tank, whereby the valve prevents the liquid from traveling from the tank into the channel;

exerting a force on the arm portion of the releasing mechanism so that the connector portion of the releasing mechanism disengages the valve to allow the liquid to exit the tank by flowing into the channel and out of the terminal end of the channel and into a toilet bowl to flush any contents of the toilet bowl.

7. The method of claim 6, wherein upon disengaging the valve, the liquid initially enters a rigid portion of the channel and subsequently enters a flexible portion of the channel.

8. The method of claim 6, including locating liquid from the tank into a first toilet bowl upon exerting the force on the arm portion.

9. The method of claim 8, including wheeling the tank to a second toilet bowl.

10. The device of claim 1, wherein the stand includes one or more wheels.

11. The device of claim 1, wherein a hose is connected to the device.

12. The device of claim 1, wherein the stand includes a platform.

13. The device of claim 1, wherein the device includes a power source.

14. The device of claim 1, wherein the device includes a drawer.

15. The device of claim 1, wherein the device includes a sensor for preventing overflow of the water located into the toilet bowl.

16. The method of claim 6, including moving via one or more wheels the tank from a first toilet to a second toilet.

17. The method of claim 6, including collecting water in the tank from grey water tanks.

18. The method of claim 6, wherein the stand includes a platform.

19. The method of claim 6, wherein the stand includes a drawer.

20. The method of claim 6, including providing a power source.

* * * * *